US006648218B2

(12) United States Patent
Katsuyama et al.

(10) Patent No.: US 6,648,218 B2
(45) Date of Patent: Nov. 18, 2003

(54) POWDER CONTAINER, METHOD OF ASSEMBLING THE SAME AND IMAGE FORMING APPARATUS

(75) Inventors: Goro Katsuyama, Kanagawa (JP); Seiji Terazawa, Shizuoka (JP); Fumio Ogata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/779,607

(22) Filed: Feb. 9, 2001

(65) Prior Publication Data

US 2001/0021325 A1 Sep. 13, 2001

(30) Foreign Application Priority Data

Feb. 14, 2000 (JP) ..... 2000-035919
Jan. 15, 2001 (JP) ..... 2001-006924

(51) Int. Cl.[7] ..... B65D 5/56; G03G 15/08

(52) U.S. Cl. ..... 229/117.35; 220/495.06; 222/105; 222/DIG. 1; 399/258

(58) Field of Search ..... 229/117.27, 117.28, 229/117.3, 117.35; 222/105, DIG. 1; 220/495.01, 495.05, 495.06; 383/119; 399/258

(56) References Cited

U.S. PATENT DOCUMENTS 3,526,566 A * 9/1970 McIlvain, Jr. et al. ..... 229/930
4,120,420 A * 10/1978 Dirksong ..... 229/117.3
4,373,929 A * 2/1983 Smith ..... 229/930
4,489,765 A * 12/1984 Yamada et al. ..... 222/DIG. 1
4,502,514 A * 3/1985 Ballard et al. ..... 222/DIG. 1
4,523,615 A * 6/1985 Feenstra et al. ..... 222/DIG. 1
5,048,691 A * 9/1991 Heuberger et al. ..... 229/117.3
5,147,062 A * 9/1992 Heuberger et al. ..... 229/117.27
5,454,483 A * 10/1995 Ichikawa et al. ..... 220/495.01
5,579,945 A * 12/1996 Ichikawa et al. ..... 220/495.06
5,909,841 A * 6/1999 Andrews, Sr. et al. .. 229/117.35
6,298,885 B1 * 10/2001 Yoshino et al. ..... 220/495.01
6,304,739 B1 * 10/2001 Katsuyama et al. ..... 399/262
6,507,720 B2 * 1/2003 Kabumoto et al. ..... 399/258
6,519,436 B2 * 2/2003 Katsuyama ..... 399/258
6,532,352 B2 * 3/2003 Katsuyama ..... 399/262

FOREIGN PATENT DOCUMENTS

| | | |
|---|---|---|
| EP | 0 627 673 | 12/1994 |
| EP | 0 728 675 | 8/1996 |
| EP | 1 014 214 | 6/2000 |
| EP | 1 030 227 | 8/2000 |
| JP | 7-134484 | 5/1995 |
| JP | 9-22175 | 1/1997 |
| JP | 11-119536 | 4/1999 |

OTHER PUBLICATIONS

Robert D. Russell, Xerox Disclosure Journal, vol. 23, No. 1, pp. 39–40, "Disposable Liner for a Toner Container", Jan./Feb. 1998.

B. S. Kudsi, et al., IBM Technical Disclosure Bulletin, vol. 15, No. 3, pp. 755–755a, "Packaging Container for Powder Material", Aug. 1972.

U.S. patent application Ser. No. 09/420,578, filed Oct. 19, 1999, pending.

U.S. patent application Ser. No. 09/752,447, filed Jan. 03, 2001, pending.

* cited by examiner

*Primary Examiner*—Gary E. Elkins
(74) *Attorney, Agent, or Firm*—Oblon, Spivak, McClelland, Maier & Neustadt, P.C.

(57) ABSTRACT

A powder container of the present invention is made up of a deformable bag for storing desired powder and a box more rigid than the bag for accommodating the bag. The bag includes an outlet portion for discharging the power. Despite that the bag is flexible, the powder container does not fall down when mounted to an image forming apparatus. Further, the powder container is easy to assemble and easy to transport at the time of collection. A method of assembling the toner container and an image forming apparatus using the same are also disclosed.

31 Claims, 11 Drawing Sheets

POWDER CONTAINER, METHOD OF ASSEMBLING THE SAME AND IMAGE FORMING APPARATUS

BACKGROUND OF THE INVENTION

The present invention relates to a powder container, a method of assembling the same and an image forming apparatus. More particularly, the present invention relates to a toner container for storing toner applicable to an electrophotographic image forming apparatus, a method of assembling the same, and a printer, copier, facsimile apparatus or similar image forming apparatus.

It has been customary with an image forming apparatus to use a toner container implemented as a cartridge, bottle or similar hard case. The kind of toner container, however, has a problem in the replacement aspect. Specifically, a manufacturer shipped the hard toner container to a user's station collects the container run out of toner and then recycles, reuses or burns it. The hard toner container needs high distribution costs up to the time of collection.

In light of the above, a toner container whose volume can be reduced has been proposed in the past. Such a toner, however, cannot stably replenish toner via a toner replenishing device. While a toner container whose volume can be reduced only during transport has also been proposed, it causes toner to fly about and contaminate surroundings when transferred to a hard bottle or a toner hopper.

Further, a toner replenishing device has been proposed that can stably replenish toner even from a toner container implemented by a resin, paper or similar flexible sheet and can replenish it to a developing unit remote from the container. The toner container includes a flexible bag storing toner and is used in an upright position with a toner outlet facing downward. A problem with this configuration is that the flexible bag is apt to fall down due to its own weight to thereby stop up the toner outlet. Further, when the bag collapses due to the consumption of the toner, the resulting creases of the bag catch the toner and cause much toner to be left in the toner container. Moreover, the flexible toner container is difficult to handle at the time of replacement.

Technologies relating to the present invention are disclosed in, e.g., Japanese Patent Laid-Open Publication Nos. 7-134484, 9-22175, and 11-119536.

SUMMARY OF THE INVENTION

It is therefore an object of the present invention to provide a powder container easy to transport and assemble and falling down little despite the use of a flexible bag, a method of assembling the same, and an image forming apparatus.

In accordance with the present invention, a powder container includes a deformable bag for storing powder, and a box more rigid than the bag for accommodating the bag. The box includes an open portion for allowing the bag to be inserted into the bag.

Also, in accordance with the present invention, a powder container includes a deformable bag for storing powder, and a box more rigid than the bag for accommodating said the. The box is polyhedral and includes walls having linear sides. Nearby walls include contiguous sides and separate sides. The box is capable of being developed in the form of a flat sheet.

Further, in accordance with the present invention, a method of assembling a toner container including a deformable bag for storing powder and a box more rigid than said the for accommodating the bag includes the steps of positioning the bag such that the outlet portion of the bag faces upward, framing the box with only the wall thereof corresponding to one side of the bag left open, inserting the bag into the box via the one side, connecting the bag and box via a connecting device, and closing the open wall to thereby complete the box.

Moreover, in accordance with the present invention, an image forming apparatus includes a powder container including a deformable bag for storing powder and a box more rigid than the bag for accommodating the bag. A powder distinguishing devices distinguishes the powder stored in the bag from another powder.

In addition, in accordance with the present invention, an image forming apparatus includes a powder container including a deformable bag for storing powder and a box more rigid than the bag for accommodating the bag. A model distinguishing device distinguishes a model of the image forming apparatus to which the box is applicable from another model.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
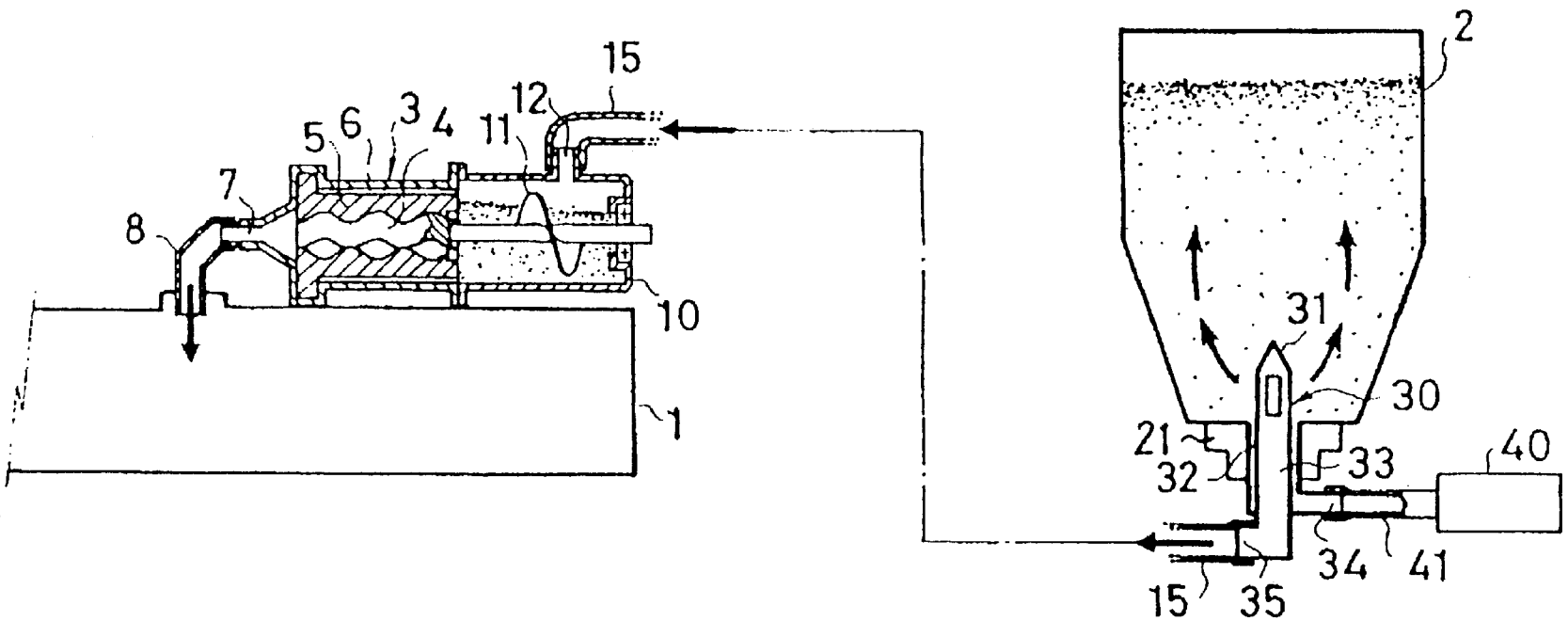
FIG. 1 is a view showing a toner replenishing mechanism included in an image forming apparatus embodying the present invention.
Figure 2:
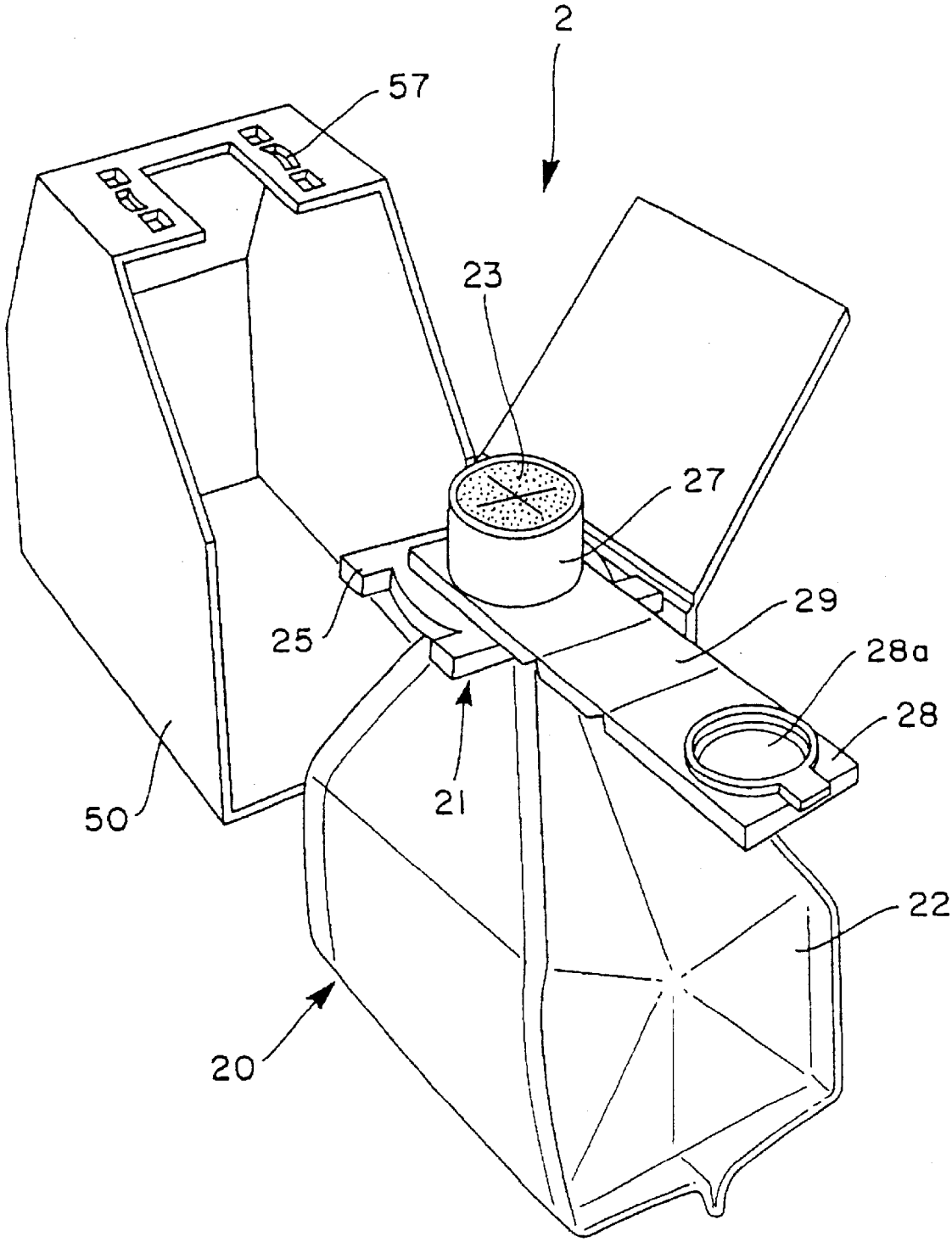
FIG. 2 is an isometric view showing a specific configuration of a toner container included in the illustrative embodiment.

Referring to FIGS. 1 and 2, a toner replenishing device included in an image forming apparatus embodying the present invention is shown. As shown, the image forming apparatus includes a developing unit 1 and a toner container 2. The toner container 2 is a specific form of a powder container and stores powdery toner. In the illustrative embodiment, the toner container 2 is implemented as a bag-in-box type container made up of a deformable bag 20 and a box 50 accommodating the bag 20. The box 50 is more rigid than the bag 20.

The toner container 2 is a unit separate from the developing unit 1 and removably mounted to a mount portion included in the body of the apparatus from above the apparatus. The mount portion may be positioned within the apparatus such that it is accessible when, e.g., a door or a cover mounted on the apparatus body is opened. Alternatively, the mount portion may be arranged on the outside of the apparatus body.

The mount portion includes an upright nozzle 30 capable of penetrating into the toner container 2 when the container is set. The nozzle 30 has a conical tip member 31 molded integrally with, adhered to or otherwise mounted on its top. The nozzle has a double-tube structure defining an air inlet passage 32 and a toner outlet passage 33, which are contiguous with the tip member 31. The toner outlet passage 33 is bent to the left, as viewed in FIG. 1, at the bottom of the nozzle 30 and formed with an opening 35 at its end. The air inlet passage 32 is bent to the right, as viewed in FIG. 1, at a level higher than the toner outlet passage 33 and formed with an opening 34 at its end.

In the illustrative embodiment, the opening 34 of the air inlet passage 32 is communicated to an air pump or air feeding means 40 by a pipe 41. The air pump 40 delivers air under pressure into the toner container 2 via the pipe 41 and air inlet passage 32. Air jetted into the toner container 2 passes through a toner layer and fluidizes the toner layer by scattering it.

A suction type powder pump 3 is located in the vicinity of or constructed integrally with the developing unit 1. The powder pump 3 is a single axis, eccentric screw pump and made up of a rotor 4, a stator 5 and a holder 6. The rotor 4 is made of metal or similar rigid material and provided with an eccentric, screw-like configuration. The stator 5 is formed of rubber or similar elastic material and provided with a double-screw configuration. The holder 6 accommodates the rotor 4 and stator 5 therein in such a manner as to form a toner passage and is formed of, e.g., resin. A toner outlet 7 is formed at the left end of the holder 6, as viewed in FIG. 1. A pipe 8 provides fluid communication between the toner outlet 7 and a toner inlet, not shown, formed in the developing unit 1.

A buffer or toner storing means 10 is connected to the inlet side of the powder pump 3 in order to store an adequate amount of toner. A screw or toner conveying means 11 is disposed in the buffer 10 and protrudes to the outside of the buffer 10 at one end. A drive source, not shown, is drivably connected to the protruding end of the screw 11. The other end of the screw 11 is connected to the rotor 4. In this configuration, the powder pump 3 and screw 11 are caused to operate at the same time as each other.

A toner inlet 12 is formed in the buffer 10. A flexible tube 15 communicates the toner inlet 12 to the opening 35 of the nozzle 30. The tube 15 has a diameter of, e.g., 4 mm to 10 mm and is formed of polyurethane, nitril, EPDM, silicone or similar rubber highly resistant to toner. The tube 15 with flexibility can be easily laid in any desired direction, i.e., upward, downward, rightward or leftward.

In the toner replenishing device having the above configuration, the powder pump or screw pump 3 can continuously deliver toner with a high solid-to-gas ratio by an accurate, constant amount, which is proportional to the rotation speed of the rotor 4, as well known in the art. In response to a replenishment command derived from, e.g., sensed image density, the powder pump 3 is operated to replenish a required amount of toner to the developing unit 1. The powder pump 3 may not include the buffer 10 or may be replaced with a discharge type powder pump, if desired.

The toner container 2 will be described more specifically with reference to FIG. 2. As shown, the bag 20 is made up of a mouth portion 21 and a bag portion 22 affixed to the mouth portion 21. The mouth portion 21 is formed of, e.g., resin by blow molding or similar technology and includes a toner outlet. The bag portion 22 is implemented by a flexible sheet or a laminate of flexible sheets formed of polyethylene, nylon or similar resin and 80 $\mu$m to 200 $\mu$m thick each.

Figure 3:
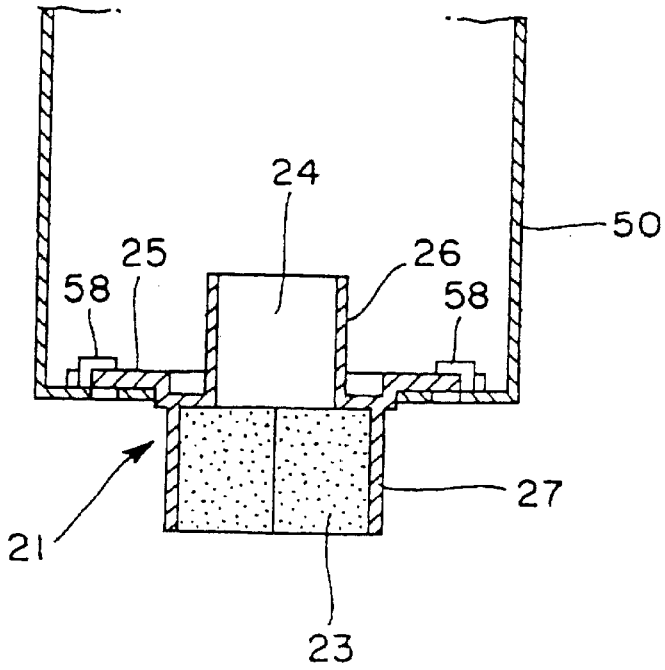
FIG. 3 is a section showing a mouth portion forming part of the toner container.
Figure 4:
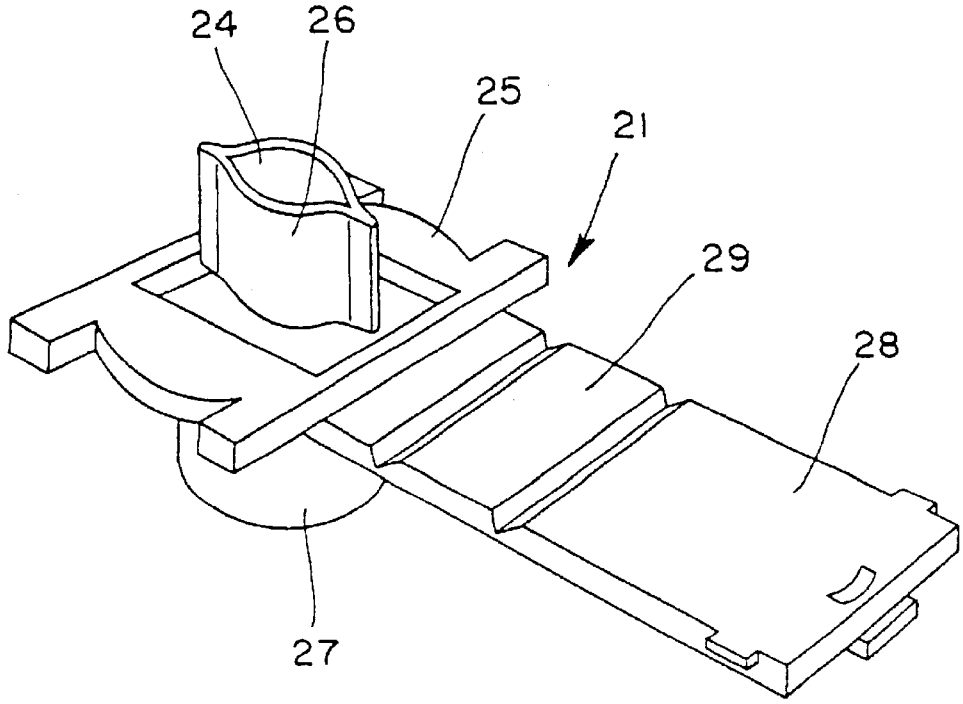
FIG. 4 is an isometric view of the mouth portion.

As shown in FIGS. 3 and 4, the mouth portion 21 includes a through hole 24 extending in the up-and-down direction and forming the toner outlet. A flat slider 25 is affixed to or formed integrally with the outer periphery of the wall that forms the through hole 24. The slider 25 is generally rectangular and constitutes projections forming part of connecting means. The bag portion 22 is affixed to a boat-shaped protuberance 26, which is also included in the mouth portion 21 above the slider 25. An outlet portion 27 is positioned below the slider 25 and forms the through hole 24. A seal valve or self-closing valve 23 is fitted in the outlet portion 27 and formed of an elastic material, preferably foam sponge. A cap 28 is formed integrally with the mouth portion 21 via a connecting portion 29 in order to close the outlet portion 27. A circular recess 28*a* is formed in the cap 28 and capable of mating with the outlet portion 27.

Figure 5:
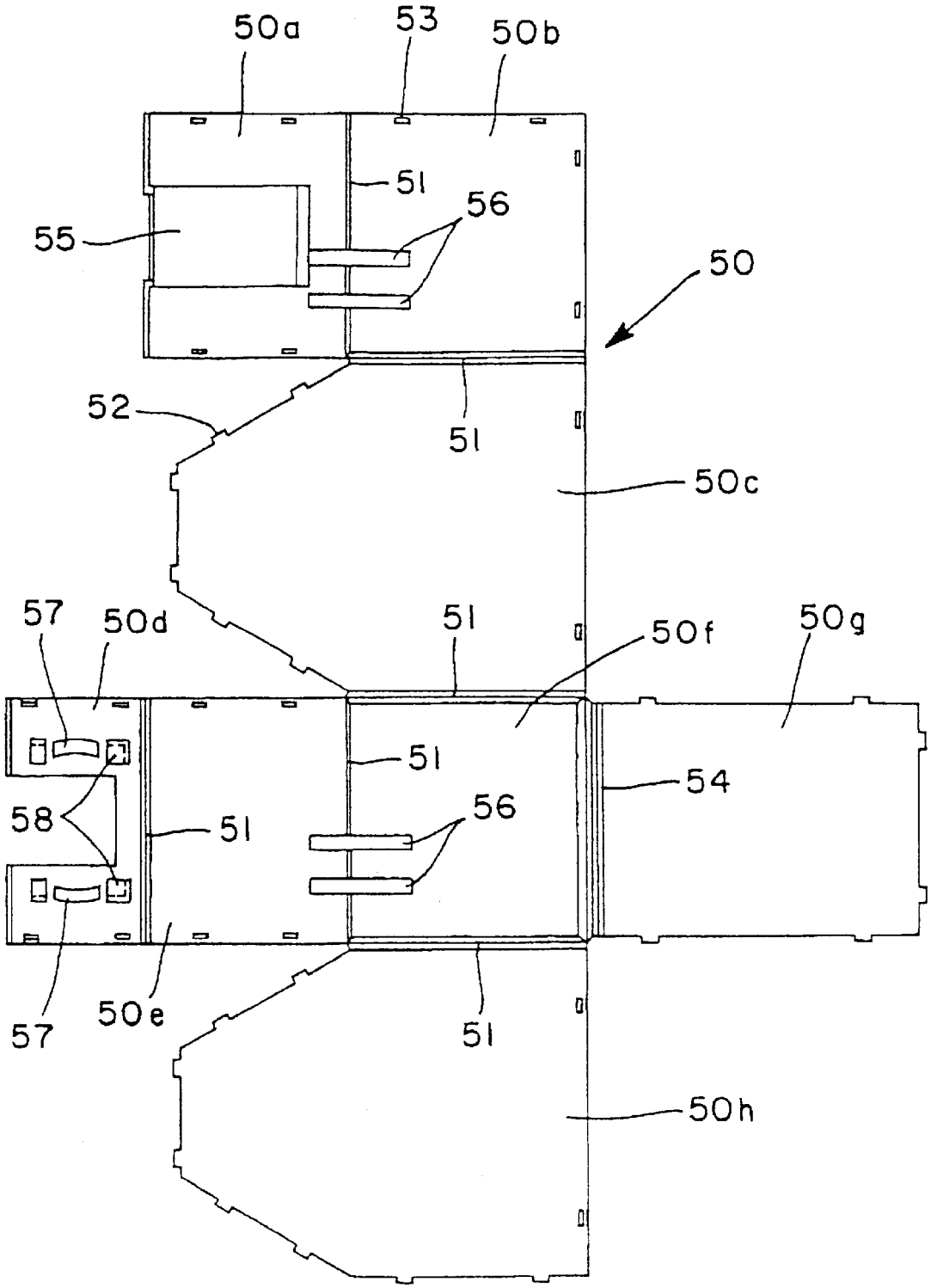
FIG. 5 is a developed view showing the inner periphery of a box forming another part of the toner container.
Figure 6:
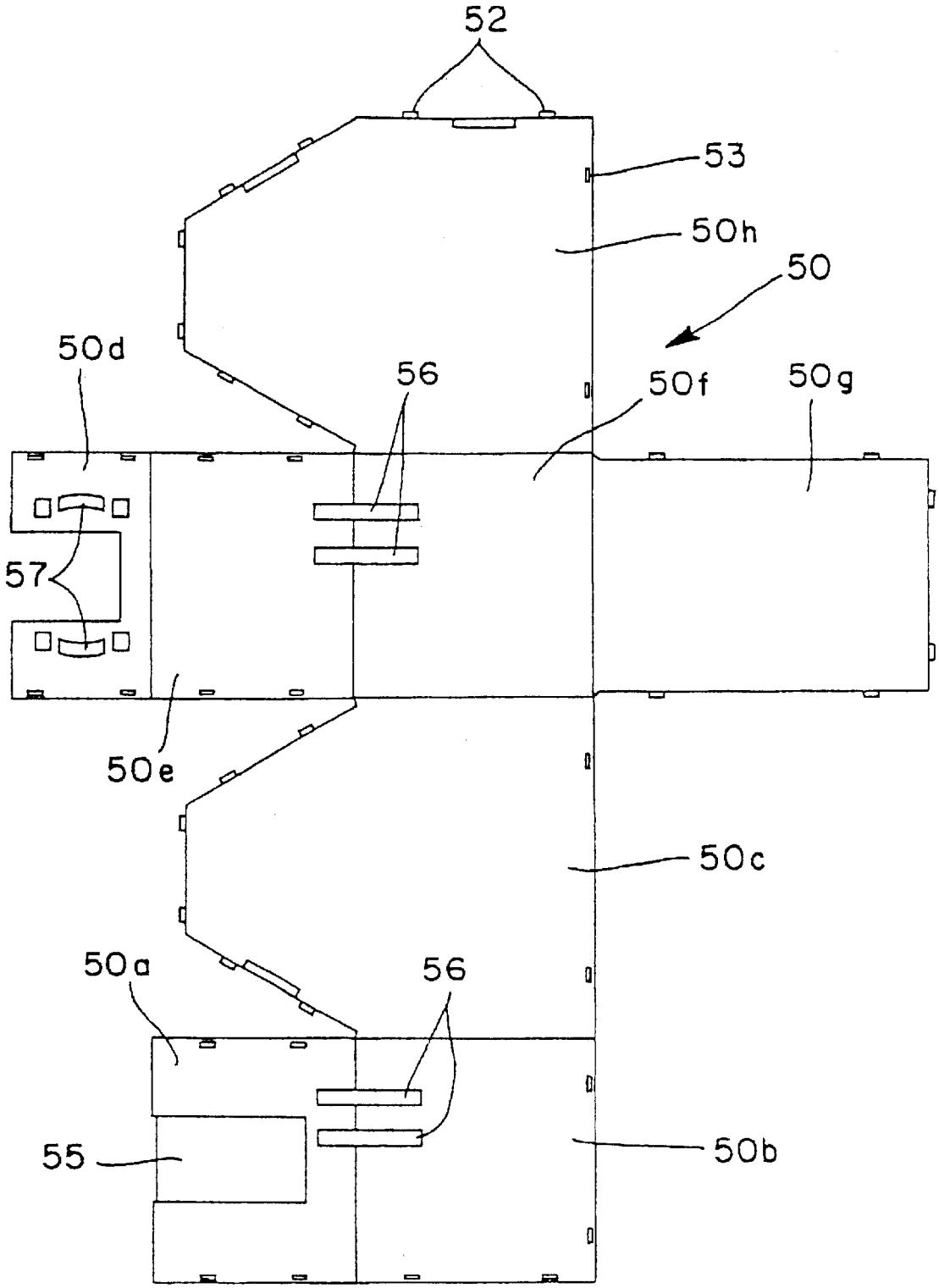
FIG. 6 is a developed view showing the outer periphery of the box.

FIGS. 5 and 6 respectively show the inner periphery and outer periphery of the box 50 in developed views. As shown, the box 50 has eight walls 50*a* through 50*h*. The walls 50*a* through 50*h* have straight sides contiguous with each other and straight sides separate from each other, and each has at least one side contiguous with the side of the adjoining wall. Therefore, by suitably selecting the contiguous sides and separate sides of the walls 50*a* through 50*h*, it is possible to develop the box 50 in the form of a single sheet having any one of various shapes. The contiguous sides prevent the walls 50*a* through 50*h* from fully parting from each other at the time of development.

Figure 7:
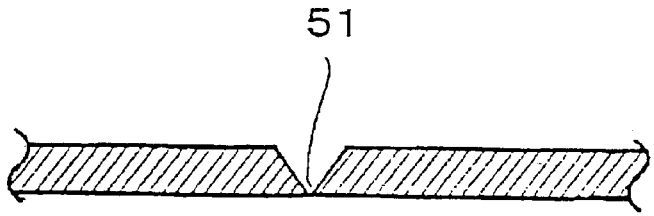
FIG. 7 is a fragmentary section of the box.

As shown in FIG. 7, a V-shaped groove 51 is formed in each of the contiguous sides of the walls 50*a* through 50*h* in order to limit a foldable angle. The angle of the letter V is selected in accordance with the angle by which each contiguous side is to be folded. For example, when the angle of the letter V is 90 degrees, nearby walls contiguous with each other via the groove 51 can be folded by substantially 90 degrees in the direction in which the surfaces forming the letter V contact each other. On the other hand, the nearby walls can be folded up to contact each other when folded in the other direction in which the surfaces forming the letter V move away from each other.

Figure 8:
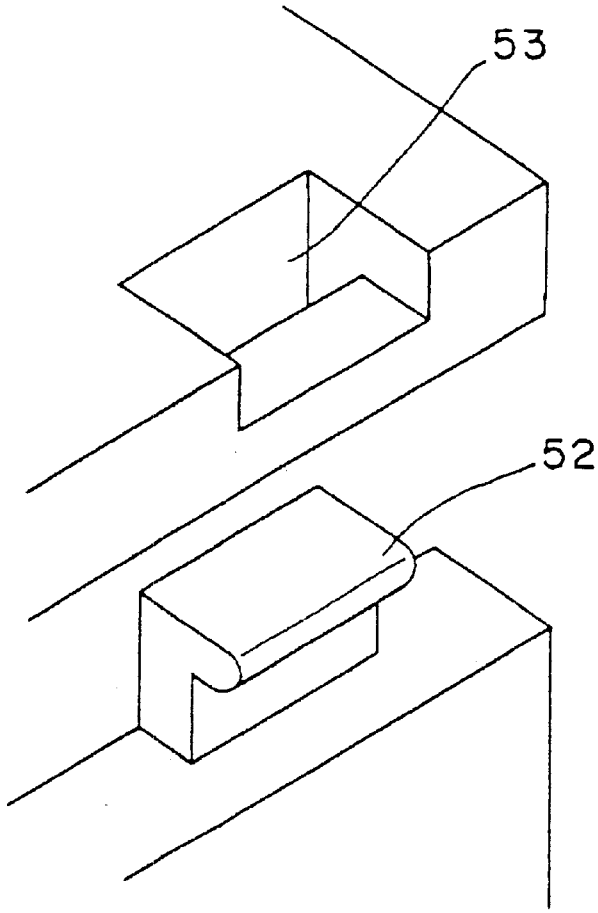
FIG. 8 is a fragmentary isometric view showing part of the box different from the part shown in FIG. 7.

As shown in FIG. 8, tongues 52 (only one is shown) protrude from one of the adjoining separate edges of the walls 50*a* through 50*h*. Recesses 53 (only one is shown) are formed in the other of the adjoining separate edges of the walls 50*a* through 50*h*. The tongues 52 and recesses 53 constitute fastening means for fastening nearby walls 50*a* through 50*h*. To frame the box 50, the walls 50*a* through 50*h* in the form of a flat sheet are folded inward in a suitable sequence with the tongues 52 mating with the recesses 53. The box 50 can therefore be framed without resorting to any tool.

Figure 9:
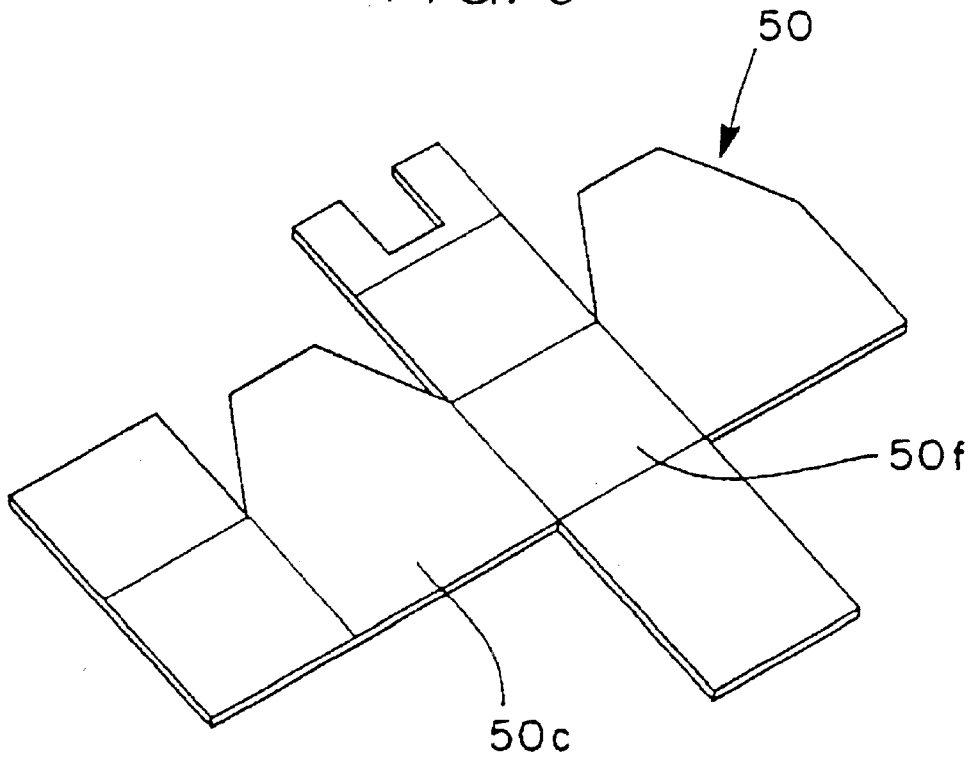
FIG. 9 is a view showing the box in the initial flat position before framing.
Figure 10:
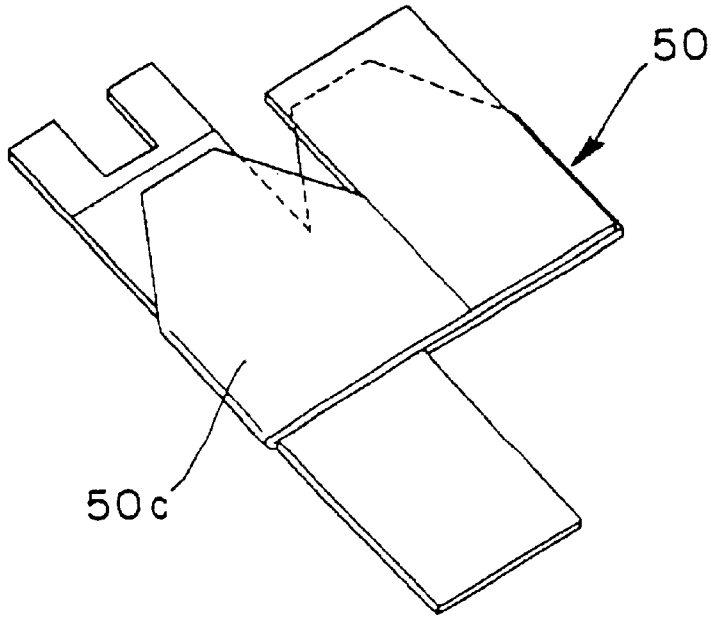
FIG. 10 is a view showing the box in a medium stage of framing.
Figure 11:
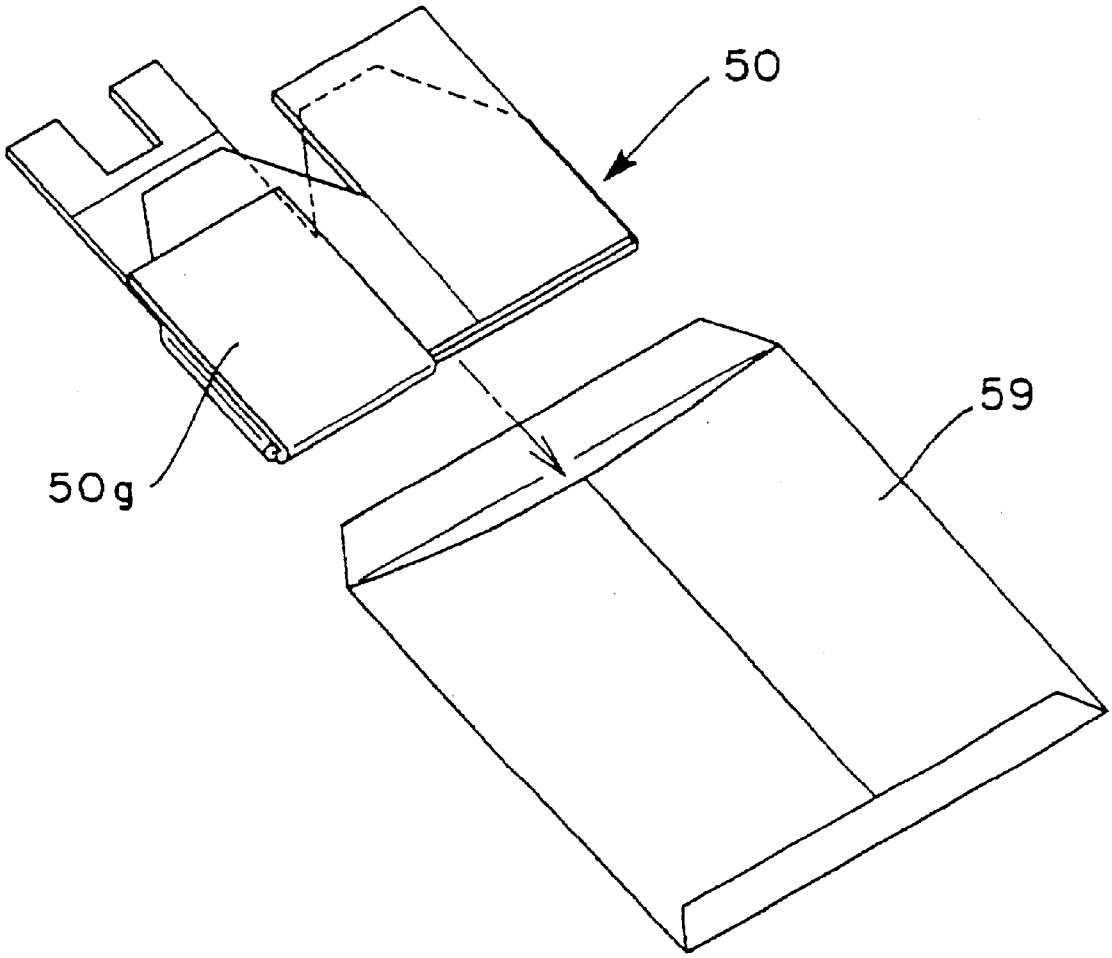
FIG. 11 is a view showing the box in the final stage of framing.
Figure 12:
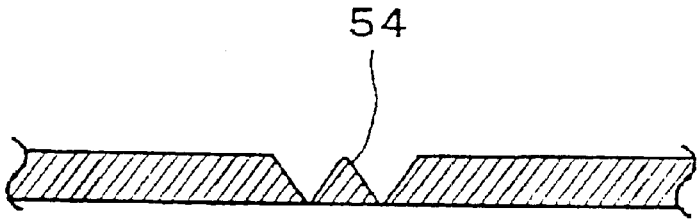
FIG. 12 is a fragmentary section showing part of the box different from the part shown in FIGS. 7 or 8.

FIG. 9 shows the box 50 in a developed position with the outer surfaces of the box 50 facing upward. As shown in FIG. 10, the box 50 in the position shown in FIG. 9 is folded in two such that the wall 50*c* lies on the wall 50*f*. As a result, the widthwise dimension of the box 50 is halved. Subsequently, as shown in FIG. 11, the wall 50*g* protruding downward from the box 50 is folded. The box 50 so folded up is small and thin enough to be put in an envelope 59 having a suitable size. As for the wall 50*g* folded last, a margin available with the V-shaped groove 51 at the time of folding is short. For this reason, as shown in FIG. 12, a groove 54 in the form of a letter W is formed in the contiguous side of the wall 50*g*.

The mouth portion 21 of the bag 20 is fitted to the wall 50*d* of the box 50. As shown in FIG. 3, guide portions 58 are formed integrally with the wall 50*d* in order to receive the slider 25 of the mouth portion 21 while guiding the slider 25.

The bag 20 is fitted to the box 50 by the following procedure. As shown in FIG. 2, the walls 50*c* through 50*h* are folded in the form of a box while the walls 50*a* and 50*b* are left flat. The bag 20 has its outlet portion 27 closed by the cap 28 in order to prevent the toner from leaking, as indicated by a dash-and-dots line in FIG. 13. Subsequently, the slider 25 of the mouth portion 21 is slid into the guide portions 58. In this manner, the bag 20 is easily received in the box 50. Thereafter, the walls 50*a* and 50*b* are folded to fully frame the box 50. At this instant, the tongues 52 and recesses 53 are caused to mate with each other between the walls 50*a* and 50*b* and the wall 50*h*.

Figure 14:
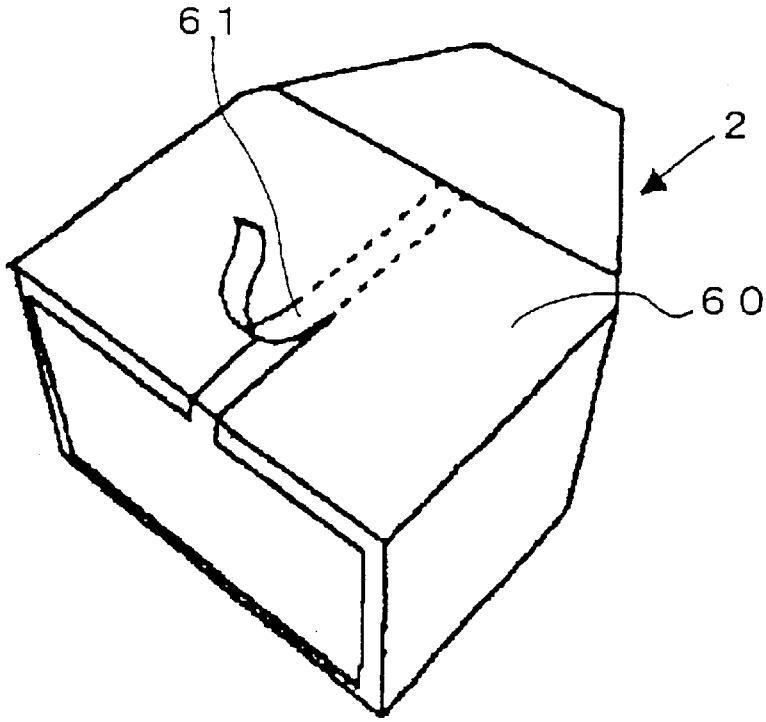
FIG. 14 is an isometric view showing the toner container in a specific complete condition.
Figure 15:
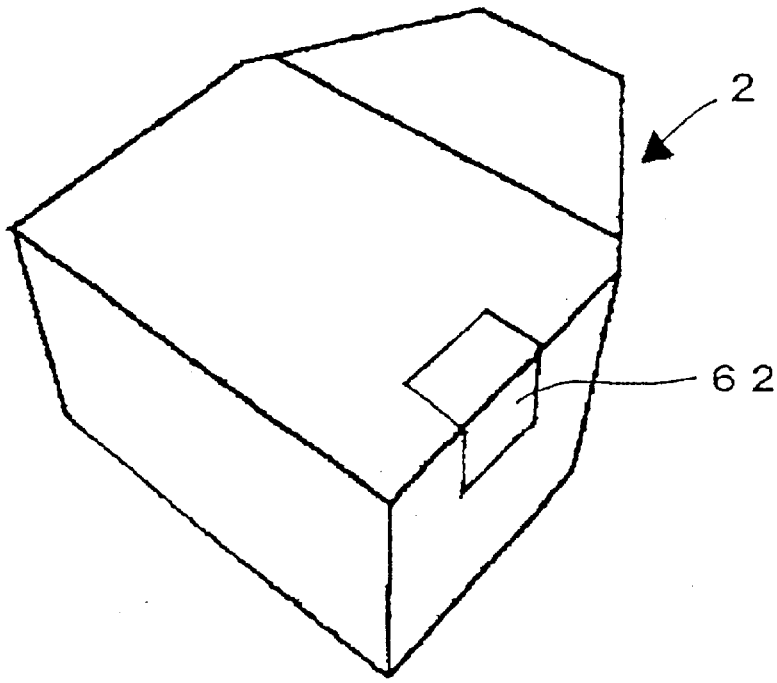
FIG. 15 is an isometric view showing the toner container in another specific complete condition.

As shown in FIG. 14, to prevent the walls 50*a* and 50*b* from easily unfolding, a seal 60 may be wrapped around all the side surfaces of the toner container 2. The seal 60 may be implemented by a thermally shrinkable seal by way of example. Further, the seal 60 may be provided with a shrink wrap 61 in order to allow the box 50 to be easily unfolded by hand. As shown in FIG. 15, the seal 60 may be replaced with an adhesive seal 62 adhered to the walls 50*a* and 50*b* folded last and the wall 50*h*.

Figure 13:
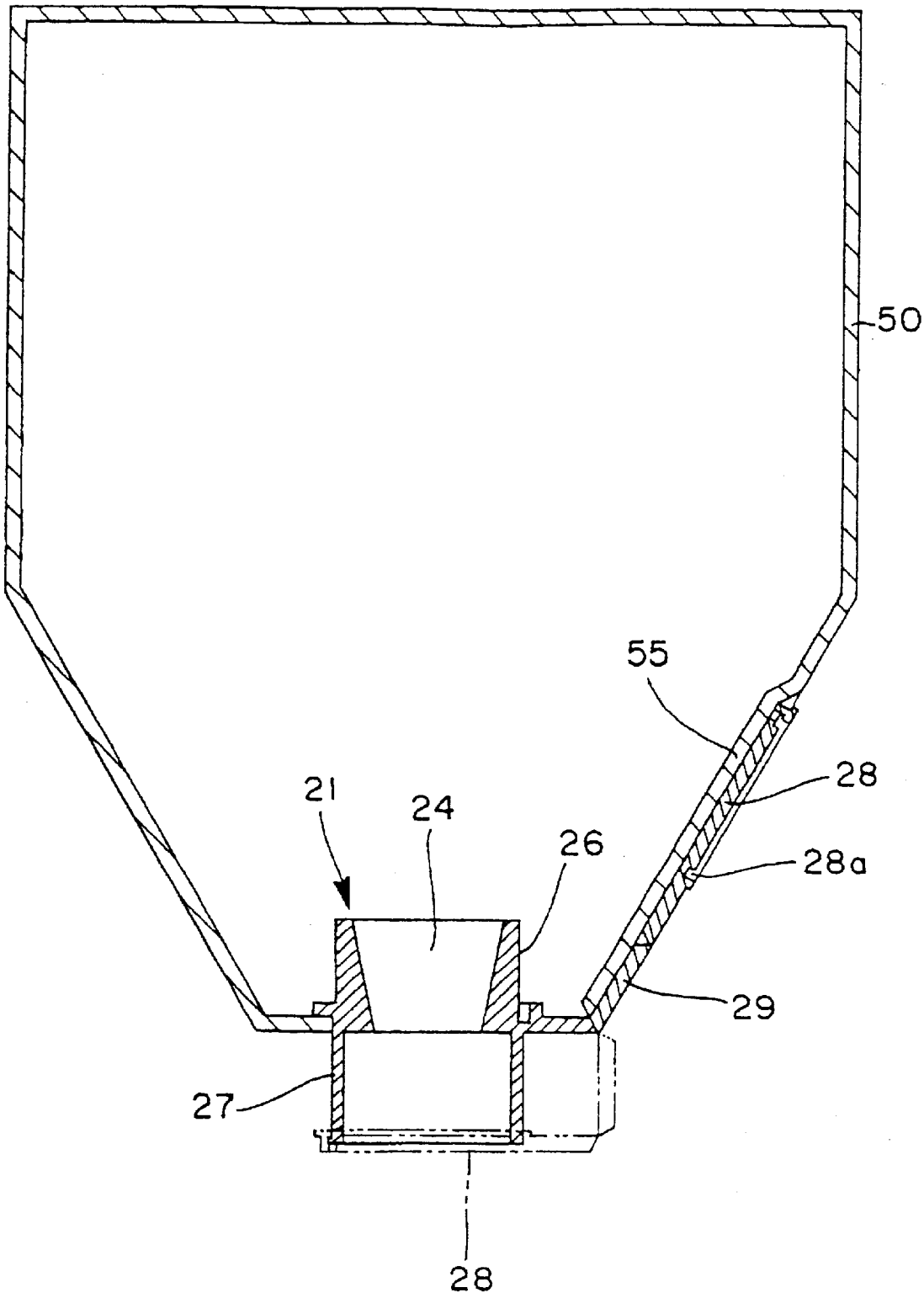
FIG. 13 is a section showing the box and mouth portion.

As shown in FIG. 13, the wall 50*a* is formed with a fitting portion 55 for fitting the cap 28. When the toner container 2 is to be used, the cap 28 is removed from the outlet portion 27 and then fitted in the fitting portion 55, as indicated by a solid line in FIG. 13. This prevents the cap 28 from obstructing the operation for mounting the toner container 2 to the apparatus body.

When the toner container 2 set on the apparatus body runs out of toner, it is picked up from the apparatus body. After the seal, if present, has been removed, the empty bag 20 is released from the box 50. The box 50 can be folded up in a small size and is therefore easy to transport or store while occupying a minimum of space. This noticeably reduces the cost necessary for the box 50 to be distributed from the user's station to the manufacturer's station. Moreover, if the box 50 is formed of a material having certain durability, then it can be repeatedly used a plurality of times and therefore contributes a great deal to cost reduction.

The bag 20 is burned for reuse or similar purpose. The flexible bag portion 22 is empty and can therefore be transported or otherwise dealt with at an extremely low cost like the box 50.

There are available toner of various colors and various properties. If inadequate toner is used, the entire developing unit must be replaced in the worst case. Particularly, it is a common practice with a full-color image forming apparatus to use toner of three different colors and black toner, which is consumed more than the other toner. A toner container storing the black toner is, in many cases, greater in size than toner containers storing the other toner. However, the toner containers storing the three color toner are identical in size, so that a person is apt to select a wrong toner container.

In light of the above, in the illustrative embodiment, mating means of a particular color is assigned to each mount portion of the apparatus body and corresponding one of the toner containers. This prevents each toner container from being set in an unexpected mount portion. As best shown in FIG. 2, the mating means, or toner distinguishing means, is implemented by arcuate recesses 57 formed in the box 50 and capable of mating with projections, not shown, positioned in a preselected mount portion included in the apparatus body. The position of the recesses 57 differs from one toner to another toner.

Alternatively, the recesses 57 may be formed in the slider 25 of the mouth portion 21, although not shown specifically. The recesses 57 formed in the slider 25 are advantageous over the recesses 57 formed in the box 50 in that it is not necessary to fabricate a particular box 50, which is repeatedly usable, for each color.

Generally, image forming apparatuses of the same model are used in various countries. While such apparatuses can share the same toner container 2, the production cost of the toner container 2 is dependent on the economical circumstances of each country. Therefore, if toner produced at low cost is used in countries where the production cost is high, then the distribution system is disturbed. To solve this problem, the illustrative embodiment additionally includes recesses 56 formed in the box 50 and playing the role of model distinguishing means. The model distinguishing means limits the model of an image forming apparatus to which the toner container 2 is applicable. In this case, each apparatus body is provided with projections, not shown, capable of mating with the recesses 56 at a particular position.

Figure 16:
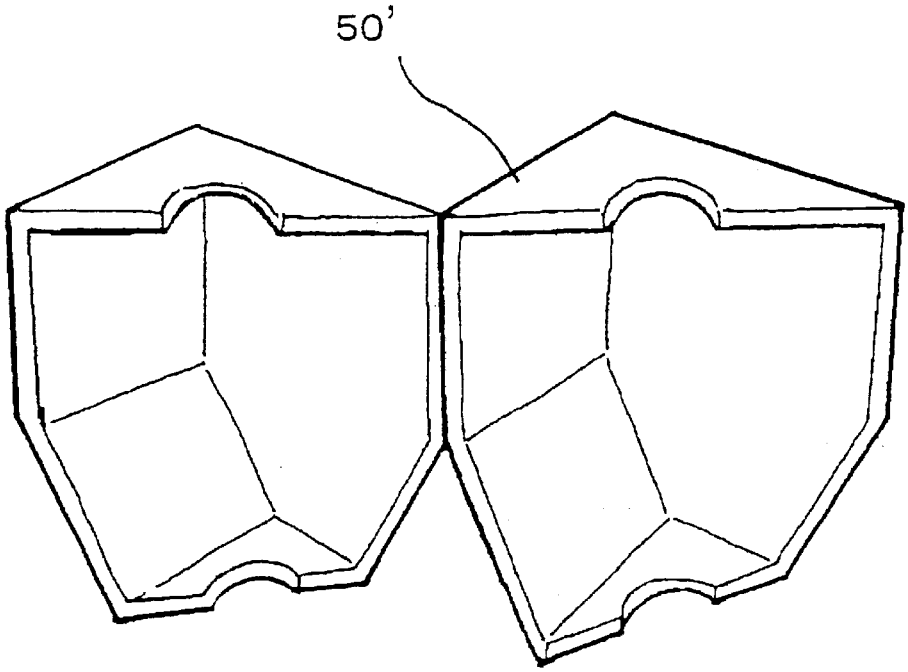
FIG. 16 is an isometric view showing an alternative embodiment of the present invention.

FIG. 16 shows an alternative embodiment of the present invention. As shown, a box 50' is openable in a right-and-left direction like a bivalve. The box 50' should preferably be openable along a diagonal line, as seen from the above, so that it can be widely opened to further facilitate the attachment of the bag not shown. Although the box 50' cannot be developed, it also saves space if a plurality of such boxes are stacked in the opened position.

Figure 17:
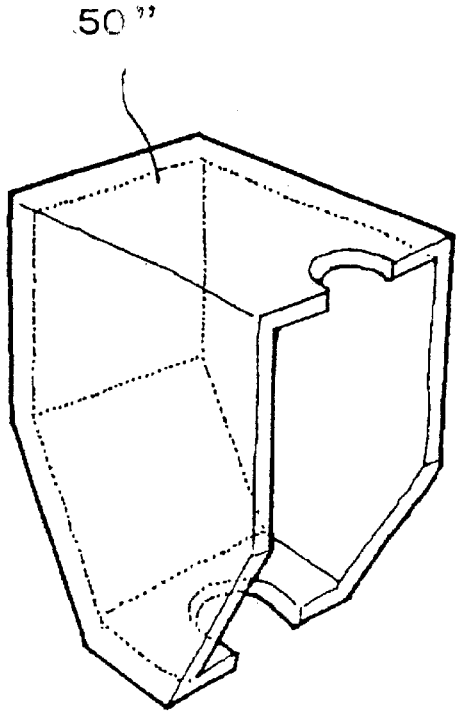
FIG. 17 is an isometric view showing another alternative embodiment of the present invention.

FIG. 17 shows another alternative embodiment of the present invention. As shown, a box 50" is constantly open at a portion corresponding to one wall, i.e., one side wall in the illustrative embodiment. The box 50" allows even the operator of the apparatus to easily attach and detach the bag 20 from the box 50". Specifically, the walls 50*a* and 50*b* of the previous embodiment are absent in the box 50", so that the box 50" can be developed or folded up in a small size.

As stated above, the bag 20 of the toner container 2 is flexible while the box 50 can be folded up in a small size or developed in the form of a flat sheet. The toner container 2 is therefore easy to handle at the time of transport or storage while saving space, compared to a hard case. The bag 20 is collected by the manufacturer and then recycled, reused or burned. The box 50 with the above advantages noticeably reduces the cost necessary for the collection and distribution thereof. The mouth portion 21, bag portion 22 and seal valve 23 of the bag 20 should preferably be formed of the same material or materials belonging to the same series, so that they do not have to be classified at the time of recycling.

In summary, it will be seen that the present invention provides a toner container including a flexible bag accommodated in a box. The box prevents the flexible bag from falling down when set on an image forming apparatus. Further, the box is foldable and therefore reduces the collection and distribution costs of the toner container to a significant degree. Moreover, the box is easy to fold and unfold and can be repeatedly used.

Various modifications will become possible for those skilled in the art after receiving the teachings of the present disclosure without departing from the scope thereof.

What is claimed is:

1. A powder container comprising:

a deformable bag for storing powder including a cap configured to be removed from an outlet portion to deliver stored powder; and a box more rigid than said bag for accommodating said bag including a fining portion configured to fit the cap when the cap is removed from the outlet portion of the bag to deliver stored powder;

wherein said box includes an open portion for allowing said bag to be inserted into said box.

2. A powder container as claimed in claim 1, further comprising connecting means for connecting said box and said bag removably received in said box.

3. A powder container as claimed in claim 2, wherein said connecting means comprises projections protruding from one of said bag and said box and recesses formed in the other of said bag and said box.

4. A powder container as claimed in claim 3, further comprising a mouth member formed with the outlet portion for discharging the powder, wherein said projections are included in said mouth member.

5. A powder container as claimed in claim 3, wherein said projections comprise a slider while said recesses comprise guide portions for allowing said slider to be slid in a preselected direction.

6. A powder container as claimed in claim 5, further comprising a mouth member formed with an the outlet portion for discharging the powder, wherein said projections are included in said mouth member.

7. A powder container as claimed in claim 2, wherein said connecting means comprises projections protruding from said bag and recesses formed in the said box.

8. A power container as claimed in claim 7, further comprising a mouth member formed with an the outlet portion for discharging the powder, wherein said projections are included in said mouth member.

9. A powder container as claimed in claim 7, wherein said projections comprise a slider while said recesses comprise guide portions for allowing said slider to be slid in a preselected direction.

10. A powder container as claimed in claim 2, further comprising a mouth member formed with the outlet portion for discharging the powder, wherein projections are included in said mouth member.

11. A powder container as claimed in claim 1, further comprising a mouth member formed with the outlet portion for discharging the powder, wherein projections are included in said mouth member.

12. A powder container comprising:

a deformable bag for storing powder including a cap configured to be removed from an outlet portion to deliver stored powder; and a box more rigid than said bag for accommodating said bag including a fitting portion configured to fit the cap when the cap is removed from the outlet portion of the bag to deliver stored powder;

wherein said bag has the outlet portion for discharging the powder at a bottom thereof and an inclined surface tapering toward said outlet portion; and wherein said box includes at least one wall inclined along said inclined surface of said bag.

13. A powder container as claimed in claim 12, further comprising connecting means for connecting said box and said bag removably received in said box.

14. A powder container as claimed in claim 13, wherein said connecting means comprises projections protruding from one of said bag and said box and recesses formed in the other of said bag and said box.

15. A powder container as claimed in claim 14, further comprising a mouth member formed with the outlet portion for discharging the powder, wherein said projections are included in said mouth member.

16. A powder container as claimed in claim 14, wherein said projections comprise a slider while said recesses comprise guide portions for allowing said slider to be slid in a preselected direction.

17. A powder container as claimed in claim 16, further comprising a mouth member formed with the outlet portion for discharging the powder, wherein said projections are included in said mouth member.

18. A powder container as claimed in claim 13, wherein said connecting means comprises projections protruding from said bag and recesses formed in the said box.

19. A powder container as claimed in claim 18, further comprising a mouth member formed with the outlet portion for discharging the powder, wherein said projections are included in said mouth member.

20. A powder container as claimed in claim 18, wherein said projections comprise a slider while said recesses comprise guide portions for allowing said slider to be slid in a preselected direction.

21. A powder container as claimed in claim 13, further comprising a mouth member formed with the outlet portion for discharging the powder, wherein projections are included in said mouth member.

22. A powder container as claimed in claim 12, further comprising a mouth member formed with the outlet portion for discharging the powder, wherein projections are included in said mouth member.

23. A powder container comprising:

a deformable bag for storing powder including a cap configured to be removed from an outlet portion to deliver stored powder; and a box more rigid than said bag for accommodating said bag including a fitting portion configured to fit the cap when the cap is removed from the outlet portion of the bag to deliver stored powder;

wherein said box is polyhedral and comprises a plurality of walls having contiguous sides and separate sides; and wherein said box is capable of being developed in a form of a flat sheet.

24. A powder container as claimed in claim 23, wherein said contiguous sides each are formed with a groove for limiting a foldable angle.

25. A powder container as claimed in claim 24, wherein after said box has been developed in the form of a sheet, said box is capable of being folded up at said contiguous sides in a flat configuration having a preselected size.

26. A powder container as claimed in claim 25, wherein a first of the plurality of walls is adapted to be folded to lie on a second and a third of the plurality of walls, the second and third walls adapted to be folded up to lie on each other, said first wall being formed with a plurality of grooves at said contiguous side for increasing an angular range over which said first wall is adapted to be folded.

27. A powder container as claimed in claim 23, wherein said walls each include fastening means for fastening nearby ones of said walls.

28. A powder container as claimed in claim 27, wherein after said box has been developed in the form of a sheet, said box is capable of being folded up at said contiguous sides in a flat configuration having a preselected size.

29. A powder container as claimed in claim 28, wherein a first of the plurality of walls is adapted to be folded to lie on a second and a third of the plurality of walls, the second and third walls adapted to be folded up to lie on each other, said first wall being formed with a plurality of grooves at said contiguous side for increasing a an angular range over which said first wall is adapted to be folded.

30. A powder container as claimed in claim 23, wherein after said box has been developed in the form of a sheet, said box is capable of being folded up at said contiguous sides in a flat configuration having a preselected size.

31. A powder container as claimed in claim 30, wherein a first of the plurality of walls is adapted to be folded to lie on a second and a third of the plurality of walls, the second and third walls adapted to be folded up to lie on each other, said first wall being formed with a plurality of grooves at said contiguous side for increasing an angular range over which said first wall is adapted to be folded.

* * * * *